US008541341B2

(12) United States Patent
Sawada

(10) Patent No.: US 8,541,341 B2
(45) Date of Patent: Sep. 24, 2013

(54) THERMAL TRANSFER SHEET

(75) Inventor: Masakazu Sawada, Kanagawa (JP)

(73) Assignee: Sony Corporation, Tokyo (JP)

( * ) Notice: Subject to any disclaimer, the term of this patent is extended or adjusted under 35 U.S.C. 154(b) by 65 days.

(21) Appl. No.: 13/354,746

(22) Filed: Jan. 20, 2012

(65) Prior Publication Data

US 2012/0189788 A1 Jul. 26, 2012

(30) Foreign Application Priority Data

Jan. 26, 2011 (JP) ..... P2011-014308

(51) Int. Cl.
*B41M 5/385* (2006.01)

(52) U.S. Cl.
USPC ..... 503/227

(58) Field of Classification Search
None
See application file for complete search history.

(56) References Cited

FOREIGN PATENT DOCUMENTS

| | | |
|---|---|---|
| EP | 0820875 | 1/1998 |
| JP | 10-35122 | 2/1998 |

*Primary Examiner* — Bruce H Hess
(74) *Attorney, Agent, or Firm* — Frommer Lawrence & Haug LLP; William S. Frommer

(57) ABSTRACT

There is provided a thermal transfer sheet including a thermal transfer dye layer formed on one surface of a base sheet and containing a dye and a heat resistant smooth layer formed on the other surface of the base sheet and containing a binder, a lubricant containing phosphoric acid ester having a melting point of 50° C. or more, and a filler. The phosphoric acid ester is contained in the heat resistant smooth layer at a ratio of 5 mass % or more and 25 mass % or less and contains straight chain phosphoric acid monoalkyl ester at a ratio of 16 mass % or more and 75 mass % or less of a total amount thereof.

4 Claims, 6 Drawing Sheets

THERMAL TRANSFER SHEET

BACKGROUND

The present disclosure relates to a thermal transfer sheet, particularly, to a component forming a heat resistant smooth layer provided in the thermal transfer sheet.

A thermal transfer method using a sublimation dye is employed for reproducing a full-color image by color dots of a multiple of colors by transferring the multiple of color dots onto a material to which the color dots are to be transferred by heating for a remarkably short time. In the thermal transfer method, a so-called sublimation type thermal transfer sheet in which a dye layer including the sublimation dye and a binder is provided on one surface of a base sheet such as a polyester film is used as a thermal transfer sheet.

Further, in the thermal transfer method, the thermal transfer sheet is heated from a back thereof by a heating unit such as a thermal head according to image information, and an image is formed by transferring a dye contained in the dye layer onto a material (printing paper) to which the dye is to be transferred. It is necessary that a friction between a surface of the thermal transfer sheet contacting the thermal head and the thermal head is stably low from a low density printing to a high density printing. Therefore, in the thermal transfer sheet in general, a heat resistant smooth layer is provided on a surface which is the other side of the surface on which the dye layer is formed for the purposes of preventing fusion with the thermal head and imparting good running smoothness (smoothing property, lubricity).

By the way, in the case of printing on a printing paper by using the thermal transfer sheet, heat is imparted to the heat resistant smooth layer from the thermal head to transfer the dye in the dye layer on the reverse surface onto the printing paper. A color optical density is proportional to heat quantity imparted from the heating unit such as the thermal head, and a surface temperature of the heating unit such as the thermal head is changed by the unit of a several hundreds of degrees (generally from an ordinary temperature to about 250° C.). Therefore, a friction coefficient between the thermal head and the heat resistant smooth layer is easily changed by a temperature change when the thermal transfer sheet moves on the thermal head. When the friction coefficient between the thermal head and the heat resistant smooth layer is changed, it is difficult for the thermal transfer sheet to move at a constant speed, and, therefore, it is difficult to obtain a clear image. More specifically, the movement of the thermal transfer sheet is temporarily slowed down when the friction coefficient is large, and a density of the slowed portion is increased to cause so-called sticking (line-like printing irregularity) or the like.

In order to prevent the sticking, it is particularly necessary to reduce the friction coefficient at high temperatures. For example, use of phosphoric acid ester or fatty acid ester as a lubricant (smoothness imparting agent) and inclusion of phosphoric acid ester or fatty acid ester in the heat resistant smooth layer have been proposed to reduce the friction coefficient at high temperatures (for example, see Japanese Patent Application Laid-Open No. 10-35122).

SUMMARY

However, phosphoric acid ester or fatty acid ester which is typically used contaminates the thermal head by volatilization or decomposition thereof caused by the heat of the thermal head. When printing is repeated by using the contaminated thermal head, the deposit is fused and stuck to a surface of the thermal head, resulting in generation of printing irregularity and the like in printing. In the case where phosphoric acid ester or fatty acid ester which has a low melting point is used for the purpose of imparting lubricity, the phosphoric acid ester or fatty acid ester is softened or molten in some cases depending on an environment when it is stored under a high temperature and a high humidity. The softening or melting tends to cause softening, aggregation, or phase separation of the binder in the heat resistant smooth layer, resulting in increase of friction coefficient and raising a possibility of impairment of the running smoothness of the thermal transfer sheet.

Further, in the case where the thermal transfer sheet is stored in a wound state, a contact between the dye layer and the heat resistant smooth layer is caused.

Therefore, particularly in a high temperature storage state, phosphoric acid ester or fatty acid ester having low melting point and high solubilizing property causes a part of the dye to be dissolved from the dye layer, thereby deteriorating storage stability of the thermal transfer sheet. As described above, the use of the phosphoric acid ester or fatty acid ester having low melting point deteriorates the storage stability of the thermal transfer sheet to cause a reduction of color optical density, generation of printing irregularity, and the like during printing.

In light of the foregoing, it is desirable to provide a thermal transfer sheet which stably has excellent running smoothness within a range of temperatures for heating the thermal transfer sheet by a heating unit and is excellent in dye storage stability without contaminating the heating unit.

According to an embodiment of the present invention, there is provided a thermal transfer sheet including a thermal transfer dye layer formed on one surface of a base sheet and containing a dye and a heat resistant smooth layer formed on the other surface of the base sheet and containing a binder, a lubricant containing phosphoric acid ester having a melting point of 50° C. or more, and a filler. The phosphoric acid ester is contained in the heat resistant smooth layer at a ratio of 5 mass % or more and 25 mass % or less and contains straight chain phosphoric acid monoalkyl ester at a ratio of 16 mass % or more and 75 mass % or less of a total amount thereof.

The phosphoric acid monoalkyl ester is preferably monooctadecyl phosphate.

The binder of the heat resistant smooth layer is preferably crosslinked by a polyisocyanate compound.

The filler of the heat resistant smooth layer may contain spherical particles containing polymethyl silsesquioxane or a mixture of the spherical particles containing polymethyl silsesquioxane and talc which is tabular particles.

According to the present disclosure, it is possible to obtain a thermal transfer sheet which stably has an excellent running smoothness within a range of temperatures for heating the thermal transfer sheet by a heating unit and is excellent in dye storage stability without contaminating the heating unit by using a predetermined amount of high melting point phosphoric acid ester as a lubricant to be contained in a heat resistant smooth layer and causing a predetermined amount of straight chain monoalkyl phosphoric acid ester to be contained in the phosphoric acid ester.

DETAILED DESCRIPTION OF THE EMBODIMENTS

Figure 1:
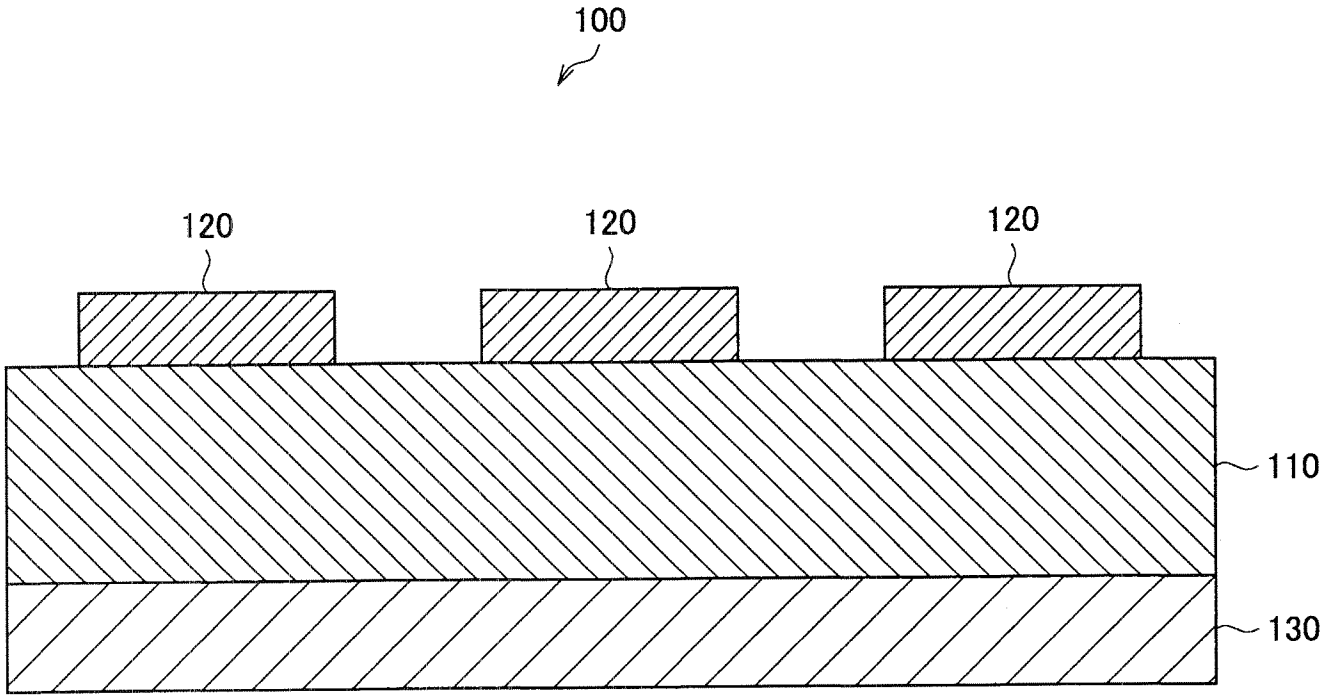
FIG. 1 is a sectional view schematically showing one configuration example of a thermal transfer sheet according to one preferred embodiment of the present disclosure.

Hereinafter, preferred embodiments of the present disclosure will be described in detail with reference to the appended drawings. Note that, in this specification and the appended drawings, structural elements that have substantially the same function and structure are denoted with the same reference numerals, and repeated explanation of these structural elements is omitted.

Description will be given in the following order.

1. Configuration of Thermal Transfer Sheet
1-1. Base sheet 110
1-2. Dye Layer 120
1-3. Detection Mark Layer 140, Transfer Protecting Layer 150, Transfer Receiving Layer 160, etc.
1-4. Heat Resistant Smooth layer 130
2. Method for Producing Thermal Transfer Sheet <1. Configuration of Thermal Transfer Sheet>

Figure 2:
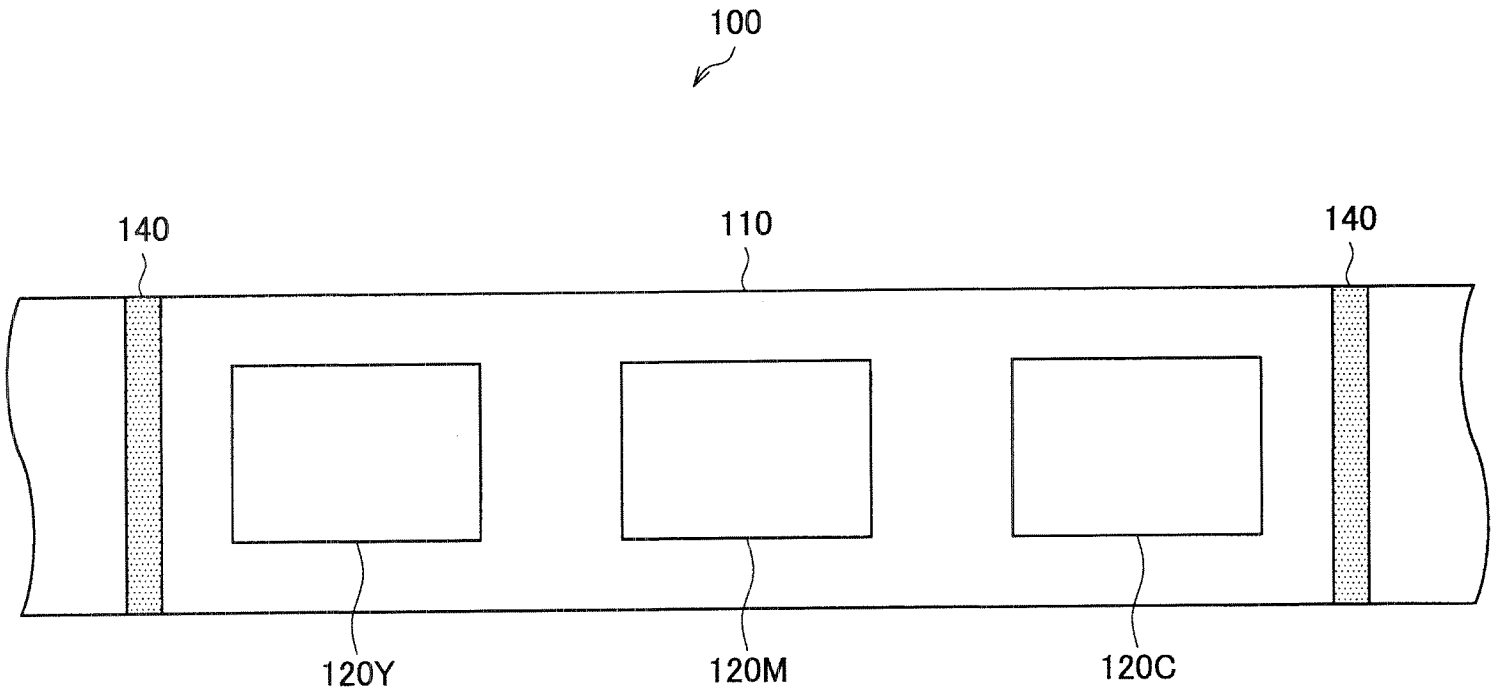
FIG. 2 is a plan view schematically showing another configuration example of the thermal transfer sheet according to the embodiment.
Figure 3:
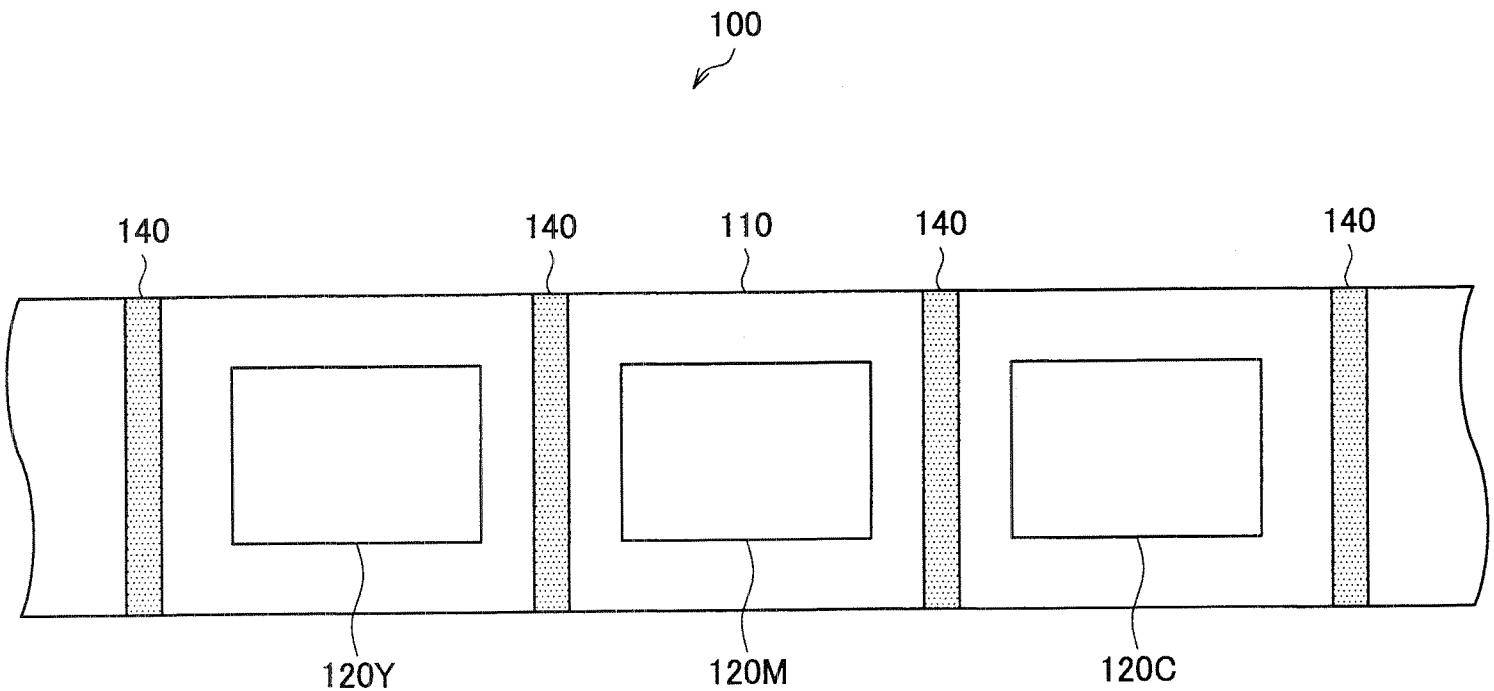
FIG. 3 is a plane view schematically showing one configuration example of the thermal transfer sheet in which a detection mark layer is provided between dye layers.
Figure 4:
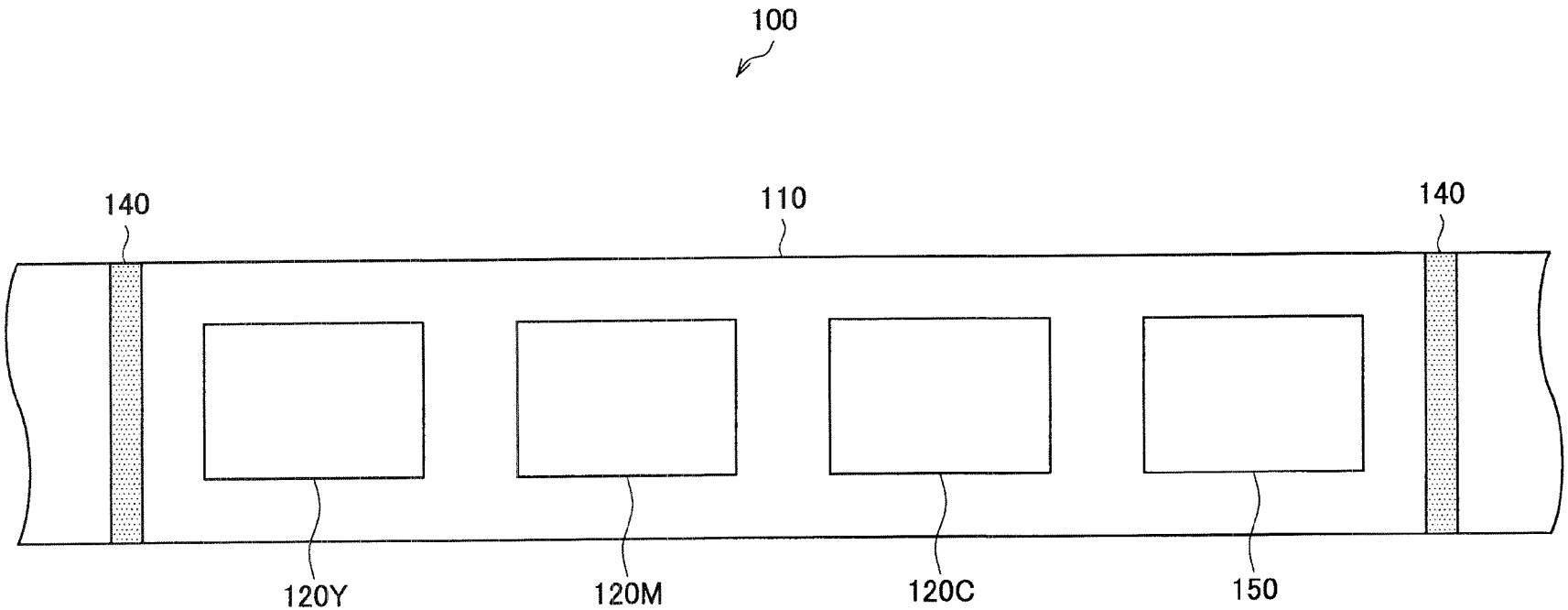
FIG. 4 is a plan view schematically showing one configuration example of the thermal transfer sheet in which a transfer protecting layer is provided.
Figure 5:
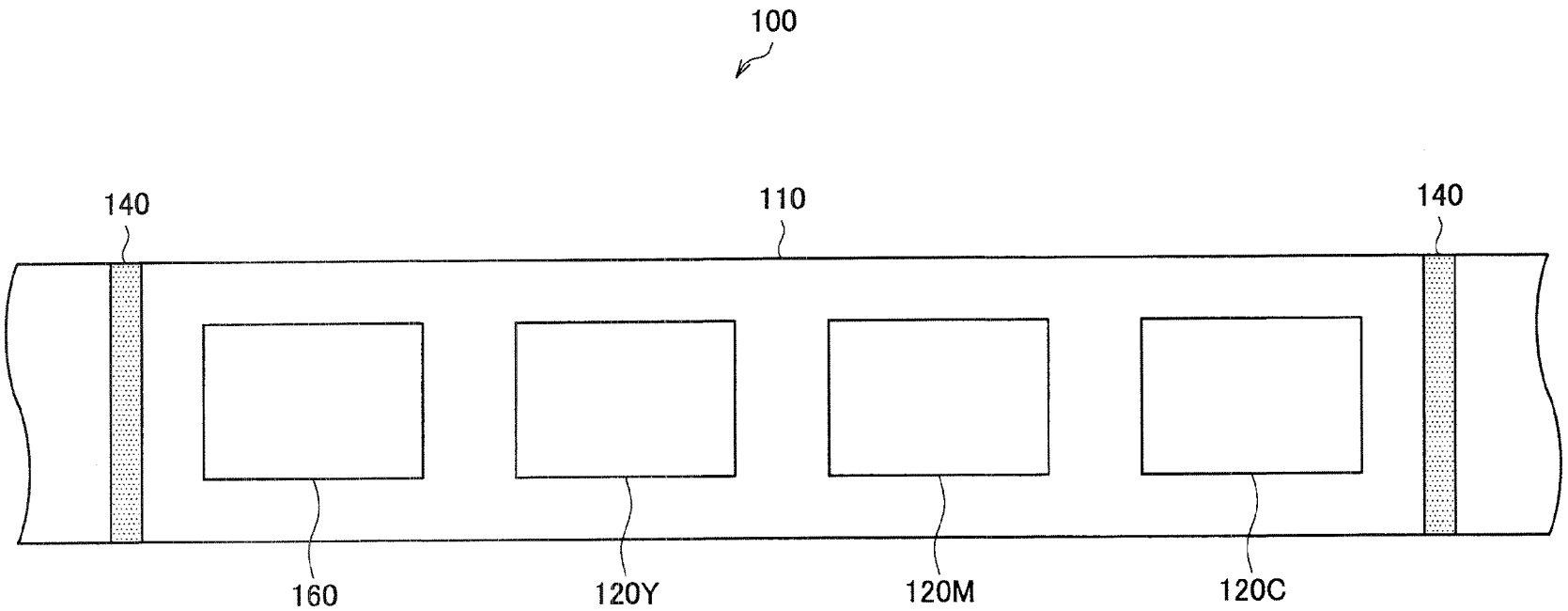
FIG. 5 is a plan view schematically showing one configuration example of the thermal transfer sheet in which a transfer receiving layer is provided.

With reference to FIGS. 1 to 5, a configuration of a thermal transfer sheet according to one preferred embodiment of the present disclosure will be described. FIG. 1 is a sectional view schematically showing one configuration example of a thermal transfer sheet according to the preferred embodiment of the present disclosure. FIG. 2 is a plan view schematically showing another configuration example of the thermal transfer sheet according to the embodiment. FIG. 3 is a plane view schematically showing one configuration example of the thermal transfer sheet according to the embodiment in which a detection mark layer is provided between dye layers. FIG. 4 is a plan view schematically showing one configuration example of the thermal transfer sheet according to the embodiment in which a transfer protecting layer is provided. FIG. 5 is a plan view schematically showing one configuration example of the thermal transfer sheet according to the embodiment in which a transfer receiving layer is provided.

As shown in FIG. 1, a thermal transfer sheet 100 according to the present embodiment includes a base sheet 110 which is a strip-like substrate, a thermal transfer dye layer 120 (hereinafter sometimes referred to as "dye layer 120") formed on one surface of the base sheet 110, and a heat resistant smooth layer 130 formed on the other surface of the base sheet 110.

[1-1. Base sheet 110]

For the base sheet 110, various substrates having heat resistance and strength of certain degrees are usable. More specifically, as the base sheet 110, a polyester film, a polystyrene film, a polypropylene film, a polysulfone film, a polycarbonate film, a polyimide film, an aramid film, or the like may be used, for example. A thickness of the base sheet 110 may arbitrarily be decided and may be 1 to 30 μm, preferably 2 to 10 μm, for example.

[1-2. Thermal Transfer Dye Layer 120]

The thermal transfer dye layer 120 is formed on the surface opposed to a printing paper of the base sheet 110. The thermal transfer dye layer 120 is formed on an entire part of the surface of the base sheet 110 as a continuous layer in the case of use for a single-color image. In the case of use for a full-color image, in general, dye layers 120Y, 120M, and 120C for colors of yellow (Y), magenta (M), and cyan (C) are separately and repeatedly formed on the base sheet 110. The order of formation of the dye layers 120Y, 120M, and 120C for the colors of yellow, magenta, and cyan is not necessarily the same as that shown in FIG. 2. Further, in the case of the use for full-color image, dye layers 120 for four colors of yellow (Y), magenta (M), cyan (C), and black (B) may be repeatedly formed.

The thermal transfer dye layer 120 is formed of at least the color dyes and binders carrying the dyes.

(Dye)

As the dye to be contained in the thermal transfer dye layer 120, an arbitrary material may be used insofar as the material is a dye which is molten, diffused, or capable of sublimation migration by heat. For example, as the yellow dye, a dye such as azo-based, disazo-based, methine-based, and pyridoneazo-based dyes or a mixture dye thereof may be used. As the magenta dye, a dye such as azo-based, anthraquinone-based, styryl-based, and heterocyclic azo-based dyes or a mixture dye thereof may be used. As the cyan dye, a dye such as indoaniline-based, anthraquinone-based, naphthoquinone-based, and heterocyclic azo-based dyes or a mixture dye thereof may be used. The dyes to be added to the thermal transfer dye layer 120 are decided by taking properties of the dyes, such as a color phase, a printing density, light resistance, storability, and solubility to binder into consideration.

(Binder)

As a binder to be used for forming the thermal transfer dye layer 120, an arbitrary material may be used. More specifically, examples of a binder for the thermal transfer dye layer 120 include an aquaresin such as cellulose-based, acrylic acid-based, and starch-based water-soluble resins; an organic solvent such as an acryl resin, polyphenylene oxide, polysalfone, polyether sulfone, and acetylcellulose, a water-soluble resin, and the like. Among these, those having a heat deflection temperature (JIS K7191) of 70° C. to 150° C. are excellent as the binder from the viewpoints of recording sensitivity and transfer body storage stability. Therefore, as the binder for the thermal transfer dye layer 120, polystyrene, polyvinyl butyral, polycarbonate, a methacryl resin, an acrylonitrile/styrene copolymer, a polyester resin, a urethane resin, polyethylene chloride, polypropylene chloride, and the like are preferred.

As a mass ratio between the dye and the binder in the dye layer 120, a value typically used for the dye layer of the thermal transfer sheet, such as 30 to 300 parts by mass of the dye relative to 100 parts by mass of the binder when dried, may be adopted.

[1-3. Detection Mark Layer 140, Transfer Protecting Layer 150, Transfer Receiving Layer 160, etc.]

In the thermal transfer sheet 100 according to the present embodiment, a detection mark layer 140, a transfer protecting layer 150, and a transfer receiving layer 160 may further be formed on the surface of the base sheet 110 on which the thermal transfer dye layer 120 is formed.

(Detection Mark Layer 140)

The detection mark layer 140 is a layer which is provided so that a printer performing thermal transfer can detect positions of the dye layer 120, the transfer protecting layer 150, the transfer receiving layer 160, and the like. In the case where the yellow color dye layer 120Y, the magenta color dye layer 120M, and the cyan color dye layer 120C are considered as a group of dye layers, the detection mark layer 140 may be provided between the adjacent groups of dye layers as shown in FIG. 2. More specifically, the detection mark layer 140, the yellow color dye layer 120Y, the magenta color dye layer 120M, and the cyan color dye layer 120C are repeatedly formed in this order on one surface of the base sheet 110 in this case. Further, the detection mark layer 140 may be provided between the adjacent color dye layers 120 as shown in FIG. 3, for example.

(Transfer Protecting Layer 150)

The transfer protecting layer 150 is a layer which is transferred onto a printing surface after printing and protects the printing surface in the case where light resistance, scratch resistance, chemical resistance, and the like of the printed matter are insufficient. The transfer protecting layer 150 is formed from a known material which is capable of protecting the printing surface, such as an organic polymer including an acryl resin, a polystyrene resin, a polyester resin, and the like, for example. Further, the transfer protecting layer 150 is provided after the group of dye layers of the yellow color dye layer 120Y, magenta color dye layer 120M, and cyan color dye layer 120C (at a side which contacts the printing paper later) as shown in FIG. 4, for example, in order to protect the printing surface after transfer of the color dyes, i.e. after the printing on a printing paper.

(Transfer Receiving Layer 160)

The transfer receiving layer 160 is provided in the case where a material onto which the dye layer 120 is to be transferred is a medium onto which it is difficult to directly transfer the dye layer 120, such as an ordinary paper or the like, and is transferred onto the material before the thermal transfer dye layers 120 are transferred. The transfer receiving layer 160 is formed of a known material onto which the dye can be transferred, and it is preferable to use the known material to which the dye is readily fixed. Further, in order that the transfer receiving layer 160 forms a receiving layer on a surface of the material such as an ordinary paper in advance of the transfer of the thermal transfer dye layer 120, the transfer receiving layer 160 is provided before the group of dye layers of the yellow color dye layer 120Y, magenta color dye layer 120M, and cyan color dye layer 120C (at a side which contacts the material first) as shown in FIG. 4, for example.

(Other Layers)

A primer layer (not shown) which reinforces adhesion between the above-described dye layer 120, detection mark layer 140, transfer protecting layer 150, and transfer receiving layer 160 and the base sheet 110 may be provided between the above-described layers and the base sheet 110 on the surface of the base sheet 110 opposed to the printing paper. Further, a known adhesion treatment such as a Colona discharge treatment, a flame treatment, and an ozone treatment may be performed in place of the formation of primer layer.

[1-4. Heat Resistant Smooth Layer 130]

The heat resistant smooth layer 130 is formed on the surface of the base sheet 110 which is reverse to the surface on which the thermal transfer dye layer 120 is formed (i.e. the surface opposed to the printing paper). When the thermal transfer dye layer 120 is transferred, the thermal transfer sheet 100 runs with the surface of the base sheet 110, which is the surface reverse to the surface opposed to the printing paper, contacting the heating unit such as the thermal head. Therefore, the heat resistant smooth layer 130 is provided for the purposes of diminishing the friction between the thermal transfer sheet 100 and the heating unit and improving running smoothness of the contact running by imparting lubricity to the base sheet 110.

The heat resistant smooth layer 130 contains a binder, a lubricant containing phosphoric acid ester having a high melting point, and a filler.

(Binder)

As the binder to be used for forming the heat resistant smooth layer 130, an arbitrary material may be used. More specifically, as the binder for the heat resistant smooth layer 130, cellulose acetate, polyvinyl acetal, an acryl resin, or the like may be used.

Further, the binder may preferably be crosslinked by a polyisocyanate compound in view of heat resistance stability and the like. As the polyisocyanate compound to be used, any one of isocyanate compounds having at least two or more isocyanate groups in molecule may be used. As the compound, tolylene diisocyanate, 4,4'-diphenylmethane diisocyanate, 4,4'-xylene diisocyanate, hexamethylene diisocyanate, 4,4'-methylenebis(cyclohexylisocyanate), methylcyclohexane-2,4-diisocyanate, methylcyclohexane-2,6-diisocyanate, 1,3-di(isocyanatemethyl)cyclohexane, isophorone diisocyanate, trimethyl/hexamethylene diisocyanate, and the like, an adduct (polyisocyanate prepolymer) obtainable by a partial addition reaction between diisocyanate and polyol, and the like are usable. As the adduct, an adduct obtained by a reaction between tolylene diisocyanate and trimethylolpropane may preferably be used, for example.

(Lubricant)

Examples of the lubricant usable for the heat resistant smooth layer 130 include polyglycerin fatty acid ester, phosphoric acid ester, fatty acid ester, fatty acid amide, and the like. Among these lubricants, the phosphoric acid ester is used as an essential component in the heat resistant smooth layer 130 according to the present embodiment. A melting point of the compound to be used as the lubricant may preferably be high, and the compound having a melting point of 50° C. or more is used. The lubricant having the melting point of 50° C. or more is used as the lubricant containing phosphoric acid ester since a low melting point tends to cause transfer of the dye to the heat resistant smooth layer 130 and transfer of the lubricant to the dye layer 120 during storage under a high temperature high humidity environment and tends to cause color shifting and friction variation.

The phosphoric acid ester described above is contained at a ratio of 5 mass % or more and 25 mass % or less in the heat resistant smooth layer 130. When the content of phosphoric acid ester in the heat resistant smooth layer 130 is small, it is difficult to attain sufficient friction in a region where a density of the dye is high, thereby causing trouble in running of the thermal transfer sheet 100. Further, when the content of phosphoric acid ester is too large, it is difficult to dissolve phosphoric ester into a solvent since phosphoric acid ester has poor solubility to the solvent. Further, when the content of phosphoric acid ester is large, a surface of the hearing unit such as the thermal head can be damaged in terms of running durability due to the acidity of phosphoric acid ester. In view of the above, it is necessary to use the phosphoric acid ester at the ratio of 5 mass % or more and 25 mass % or less in the heat resistant smooth layer 130 in order to attain satisfactory performance.

Further, it is necessary to dissolve the phosphoric acid ester into a solvent to be used, and various phosphoric acid esters may be blended for the purpose of dissolution. Many of commercially available phosphoric acid esters contain both of diester and monoester. Further, solvent-solubility of the phosphoric acid ester is reduced along with an increase in melting point, and this is caused by the low solubility of diester. Therefore, in order that the phosphoric acid ester has solvent-solubility and a high melting point, phosphoric acid monoester is necessary. Further, among phosphoric acid monoesters, phosphoric acid monoalkyl ester which is easily available is preferred. Along with an increase in length of long-chain alkyl chain to be reacted, a melting point of the phosphoric acid monoester is increased, and, in contrast, the solvent-solubility is reduced. Further, along with a decrease in length of alkyl chain, the solvent-solubility is improved, but acidity tends to be increased to raise possibility of corrosion of the heating unit such as the thermal head. Therefore, as the phosphoric acid monoester having high melting point and solvent-solubility, C14, C16, or C18 straight chain phosphoric acid monoalkyl ester is preferred, and, among these, it is most preferable to use C18 monooctadecyl phosphate.

Monooctadecyl phosphate is advantageous in production since it is made from C18 stearyl alcohol which is inexpensive and easily available, and C18 is the most preferred number of carbon atoms since a larger carbon atom number better suppresses the friction.

However, since transfer of the dye to the heat resistant smooth layer 130 is increased and the color phase tends to be changed under a high temperature and a high humidity when an addition amount of phosphoric acid monoalkyl ester is too large, particularly when 100% of the phosphoric acid ester is phosphoric acid monoalkyl ester. Further, when the addition amount of phosphoric acid monoalkyl ester is too small, it is sometimes difficult to attain satisfactory friction and color shift prevention effects. Therefore, a preferred amount of phosphoric acid monoalkyl ester to be added is 16 mass % or more and 75 mass % or less of a total amount of the phosphoric acid ester.

A method for producing the phosphoric acid monoalkyl ester is not particularly limited, but, in general, a reaction between diphosphor pentoxide and an alcohol is frequently employed. In the organic chemical reaction, a blend in which diester and monoester are generated is often obtained. In this case, it is necessary to remove monoester by performing separation purification of the blend of diester and monoester. Examples of ordinary methods of the separation purification include column chromatography, recrystallization, organic solvent extraction, and the like. A slight amount of diester or a raw material can be contained in phosphoric acid monoester after the purification in the case of performing the above-described production method, but, for example, it is possible to dissolve octadecyl phosphate into a solvent without any practical issue when a content of the dioctadecyl phosphate in octadecyl phosphate is 15 mass % or less.

Here, when straight chain phosphoric acid monoalkyl ester such as monooctadecyl phosphate is used in an excessive amount, the dye is transferred to the heat resistant smooth layer 130 to cause shifting of a color phase. Therefore, the heat resistant smooth layer 130 may be formed by blending various phosphoric acid esters in addition to the phosphoric acid monoalkyl ester. An ester portion of various phosphoric acid esters to be used may not necessarily be a straight chain alkyl, and, further, diester may be contained as phosphoric acid ester. However, it is necessary to use those having a melting point of 50° C. or more and can be dissolved into an ink solvent as the various phosphoric acid esters.

(Filler)

As the filler to be used for the heat resistant smooth layer 130, a filler of spherical particles is usable. As the filler of spherical particles, an inorganic filler such as silica, titanium oxide, zinc oxide, and carbon and an organic filler such as a silicone resin, a Teflon (registered trademark) resin, and a benzoguanamine resin are usable. Among these fillers of spherical particles, a silicone resin formed of polymethyl silsesquioxane is most preferred. As an average particle diameter of spherical particles of the silicone resin or the like, 0.5 μm or more and 5.0 μm or less is preferred. In the case where the particle diameter of the spherical particles is too small, it is difficult to project the filler from the surface of the heat resistant smooth layer 130, thereby making it difficult to impart a smoothing property. On the other hand, when the particle diameter of spherical particles is too large, it is difficult to transfer the heat of the heating unit such as the thermal head in printing. Further, when unevenness is formed on the surface of the heat resistant smooth layer 130 by using the spherical particles within the above-specified range of particle diameter, a contact area between the thermal transfer dye layer 120 and the heat resistant smooth layer 130 is reduced in the case where the thermal transfer sheet 100 is wound to be stored, thereby making it possible to prevent migration of the dye and improving the smoothing property. As used herein, the average particle diameter means a number average particle diameter of primary particles when measured by using a particle distribution meter.

Further, a filler of tabular particles may be used in combination with the filler of spherical particles for the heat resistant smooth layer 130. As the filler of tabular particles, an inorganic filler such as talc, clay, and mica and an organic filler such as those formed from a polyethylene resin are usable. Among these fillers of tabular particles, talc is most preferred from the viewpoint of hardness. When an average particle diameter of the tabular particles such as the talc is too small, a specific surface area of the filler is increased to increase a friction resistance in the case of a contact with the heating unit such as the thermal head. Therefore, a particle diameter of the tabular particles may preferably be larger than that of the spherical particles. On the other hand, when the average particle diameter of the tabular particles is too large, it is difficult to disperse the tabular particles such as the talc into a coating liquid, thereby causing sedimentation of particles. Further, when the average particle diameter of the tabular particles is too large, a specific surface area of the filler is reduced to make it difficult to attain a satisfactory cleaning effect. Therefore, as the tabular particles, those having an average particle diameter of 1.0 μm or more and 10.0 μm or less may preferably be used. As used herein, the average particle diameter means a number average particle diameter (D50) of primary particles when measured by employing a laser diffraction method.

Further, when an amount of the filler to be added to the heat resistant smooth layer 130 is too large, the filler tends to sediment in the coating liquid, thereby making it difficult to apply the coating liquid for the heat resistant smooth layer 130 and to increase friction. Therefore, it is preferable to appropriately adjust the amount of the filler to be added. More specifically, the amount of the filler to be added to the heat resistant smooth layer 130 may preferably be 5.0 mass % or less.

<2. Method for Producing Thermal Transfer Sheet>

The configuration of the thermal transfer sheet according to one preferred embodiment of the present disclosure is described above, and, hereinafter, a method for producing the thermal transfer sheet according to one preferred embodiment of the present disclosure will be described.

[2-1. Formation of Heat Resistant Smooth Layer 130]

The coating for the heat resistant smooth layer 13 is prepared by dissolving or dispersing the additives such as the above-described binder, lubricant, and filler into a predetermined solvent. The addition amount of the phosphoric acid ester used as the lubricant is such an amount that the phosphoric acid ester is contained in the heat resistant smooth layer 130 after the formation (curing) of the heat resistant smooth layer 130 at the ratio of 5 mass % or more and 25 mass % or less. Further, as the phosphoric acid ester to be used, the straight chain phosphoric acid monoalkyl ester is contained at a ratio of 16 mass % or more and 75 mass % or less relative to a total amount of the phosphoric acid ester. The type of the solvent and a mass ratio between the additives and the solvent may appropriately be decided so that the additives are satisfactorily dissolved or dispersed into the solvent.

The coating liquid is applied onto one surface of the above-described base sheet 110 by employing a gravure printing method, a screen printing method, a reverse roll coating method using a gravure plate, or the like, for example, followed by drying. Drying conditions are not particularly limited and can appropriately be set such that the solvent used for dissolving the binder, lubricant, filler, and the like is volatilized. Further, a heat curing treatment (aging treatment) of the dried heat resistant smooth layer 130 is performed as required. Aging treatment conditions are not particularly limited insofar as the heat resistant smooth layer 130 is satisfactorily cured under the conditions, but heating conditions of about 50° C. for about one week may be employed, for example. The heat resistant smooth layer 130 is formed as described above. The heat resistant smooth layer 130 may preferably be formed such that a thickness thereof when dried is from 0.1 to 5 μm. When the thickness of the heat resistant smooth layer 130 is too large, it is difficult to project the filler from the surface of the heat resistant smooth layer 130, thereby making it difficult to impart the smoothing property and raising a risk of powder generation or the like.

[2-2. Formation of Thermal Transfer Dye Layer 120]

Next, a coating liquid for the thermal transfer dye layer 120 is prepared by adding the dye, the binder, and other additives to be added as required to a predetermined solvent and dissolving or dispersing the components. The type of the solvent and a mass ratio between the dye, binder, and additives and the solvent may appropriately be decided so that the additives are satisfactorily dissolved or dispersed into the solvent.

The coating liquid is applied onto a surface of the base sheet 110, which is reverse to the surface on which the heat resistant smooth layer 130 is formed as described above, followed by drying. As the coating method, a known method such as a gravure printing method, a screen printing method, and a reverse roll coating method using a gravure plate may be employed. Drying conditions are not particularly limited and can appropriately be set so that the solvent used for dissolving the dye, binder, and the like is volatilized. The thermal transfer dye layer 120 is formed as described above. It is preferable to form the thermal transfer dye layer 120 such that a thickness thereof when dried is 0.1 to 5.0 μm, particularly preferably 0.1 to 3.0 μm. Further, as the thermal transfer dye layer 120, dye layers of a plurality of color phases of yellow, magenta, cyan, black, and the like may sequentially be formed or a dye layer of a single color phase may be formed on an entire part of the surface of the base sheet 110.

EXAMPLES

Hereinafter, the present disclosure will be described in more details by using examples to which the present disclosure is adopted.

[Material for Heat Resistant Smooth Layer]

In the following examples and comparative examples, the following compounds 1 to 6 are used as the lubricant, and the following compounds 7 and 8 are used as the filler. The compound 1 is obtainable by separating and extracting monoester from the compound 4.

<Lubricant (Phosphoric Acid Ester)>

Compound 1: Monooctadecyl Phosphate (purity: 94.2%, monoester:dietster=98:2 (mass ratio), melting point: 82° C., acid value: 308 mgKOH/g, number of carbon atoms of alkyl chain: C18)

Compound 2

(product of Toho Chemical Industry Co., Ltd., trade name: RL-210, melting point: 55° C., acid value: 95 mgKOH/g, number of carbon atoms of alkyl chain: C18, average molar number of ethylene oxide: 2)

Compound 3

(product of Toho Chemical Industry Co., Ltd., trade name: GF-199, melting point: 44° C., acid value: 168 mgKOH/g, number of carbon atoms of alkyl chain: C12)

Compound 4

(product of SC Organic Chemical Co., Ltd., trade name: Phoslex A-18, melting point: 70° C., acid value: 230 mgKOH/g, number of carbon atoms of alkyl chain: C18, monoester:dietster=1.7:1 (mass ratio))

Compound 5

(product of Toho Chemical Industry Co., Ltd., trade name: GF-185, melting point: −14° C., acid value: 158 mgKOH/g, number of carbon atoms of alkyl chain: C13)

Compound 6: Fatty Acid Ester (product of Kao Corporation, trade name: Exceparl PE-TP, melting point: 67° C.)

<Filler>

Compound 7: Spherical Silica (Product of Toshiba Silicone Co., Ltd., trade name: Tospearl XC99, average particle diameter: 0.7 μm)

Compound 8: Talc (product of Nippon Talc Co., Ltd., trade name: SG-95, average particle diameter: 2.5 μm)

[Production of Thermal Transfer Sheet]

(Formation of Heat Resistant Smooth Layer)

A polyester film (product of Toray Industries, Inc., trade name: Lumilar) having a thickness of 6 μm was used as the base sheet. As the binder for the heat resistant smooth layer, 100 parts by mass of a polyacetal resin (product of Sekisui Chemical Co., Ltd., trade name: KS-3Z) and 20 parts by mass of polyisocyanate (product of Nippon Polyurethane Industry Co., Ltd., trade name: Coronate L, purity: 45 mass %) were used. As the lubricant for the heat resistant smooth layer, phosphoric acid ester and fatty acid ester of the types shown in Table 1 were used in such amounts that amounts thereof contained in the heat resistant smooth layer after the formation become those shown in Table. 1. As the filler for the heat resistant smooth layer, the filler of the type shown in Table 1 was added in such an amount that the amount thereof contained in the heat resistant smooth layer after the formation becomes that shown in Table. 1. The binder, lubricant, and filler were dissolved into 1900 parts by mass of a mixture solvent of methylethylketone and toluene (mixture ratio: methylethylketone:toluene=1:2) to prepare a coating liquid for the heat resistant smooth layer. The coating liquid was applied on one surface of the above-described base sheet such that a thickness after drying was 0.5 μm, dried, and heat-cured at 50° C. for one week. Thus, the heat resistant smooth layers of Example 1 to Example 11 and Comparative Example 1 to Comparative Example 9 shown in Table 1 were obtained.

In Table 1, in addition to the types and the contents in the heat resistant smooth layer of the lubricant and the filler, a content of phosphoric acid ester and a ratio of phosphoric acid monoalkyl ester (C18 monooctadecyl phosphate in Examples) to the phosphoric acid ester in the heat resistant smooth layer after the formation are shown. Further, each of the contents of the lubricants and the fillers, contents of phosphoric acid ester in the heat resistant smooth layer, and the ratios of phosphoric acid monoalkyl ester in Table 1 is a mass ratio of the amount to be contained in the heat resistant smooth layer after the formation.

TABLE 1

| | Type of lubricant | Content of lubricant (mass %) | Content of phosphoric acid ester (mass %) | Ratio of phosphoric acid monoester in total phosphoric acid ester | Type of filler | Content of filler (mass %) |
|---|---|---|---|---|---|---|
| Example 1 | Compound 1 | 6.67 | 7.63 | 62.7 | Compound 7 | 1 (0.76) |
| | Compound 2 | 3.33 | | | | |
| Example 2 | Compound 1 | 13.34 | 14.18 | 62.7 | Compound 7 | 1 (0.70) |
| | Compound 2 | 6.66 | | | | |
| Example 3 | Compound 1 | 26.68 | 24.8 | 62.7 | Compound 7 | 1 (0.62) |
| | Compound 2 | 13.32 | | | | |
| Example 4 | Compound 1 | 13.34 | 13.6 | 62.7 | Compound 7 | 1 (0.68) |
| | Compound 2 | 6.66 | | | | |
| | Compound 7 | 5 | | | | |
| Example 5 | Compound 1 | 13.34 | 14 | 62.7 | Compound 7 | 1 (0.70) |
| | Compound 2 | 6.66 | | | Compound 8 | |
| Example 6 | Compound 1 | 2 | 7.63 | 18.8 | Compound 7 | 1 (0.76) |
| | Compound 2 | 8 | | | | |
| Example 7 | Compound 1 | 4 | 14.18 | 18.8 | Compound 7 | 1 (0.70) |
| | Compound 2 | 16 | | | | |
| Example 8 | Compound 1 | 8 | 24.8 | 18.8 | Compound 7 | 1 (0.62) |
| | Compound 2 | 32 | | | | |
| Example 9 | Compound 1 | 7.5 | 7.63 | 70.65 | Compound 7 | 1 (0.76) |
| | Compound 2 | 2.5 | | | | 1 (0.61) |
| Example 10 | Compound 1 | 15 | 14.18 | 70.65 | Compound 7 | 1 (0.70) |
| | Compound 2 | 5 | | | | |
| Example 11 | Compound 1 | 30 | 24.8 | 70.65 | Compound 7 | 1 (0.62) |
| | Compound 2 | 10 | | | | |
| Comparative Example 1 | Compound 1 | 20 | 14.18 | 94.2 | Compound 7 | 1 (0.70) |
| Comparative Example 2 | Compound 1 | 16.67 | 14.18 | 78.46 | Compound 7 | 1 (0.70) |
| | Compound 2 | 3.33 | | | | |
| Comparative Example 3 | Compound 4 | 5 | 3.98 | 33.3 | Compound 7 | 1 (0.79) |
| Comparative Example 4 | Compound 1 | 3.33 | 14.18 | 15.7 | Compound 7 | 1 (0.70) |
| | Compound 2 | 16.67 | | | | |
| Comparative Example 5 | Compound 2 | 20 | 14.18 | — | Compound 7 | 1 (0.70) |
| Comparative Example 6 | Compound 3 | 20 | 14.18 | — | Compound 7 | 1 (0.70) |
| Comparative Example 7 | Compound 5 | 20 | 14.18 | — | Compound 7 | 1 (0.70) |
| Comparative Example 8 | Compound 1 | 1.66 | 3.98 | 62.8 | Compound 7 | 1 (0.80) |
| | Compound 2 | 3.34 | | | | |
| Comparative Example 9 | Compound 1 | 33.34 | 29.2 | 62.8 | Compound 7 | 1 (0.58) |
| | Compound 2 | 16.66 | | | | |

(Formation of Thermal Transfer Dye Layer)

Next, of each of the base sheets of Examples 1 to 11 and Comparative Examples 1 to 9, on a surface which is reverse to the surface on which the heat resistant smooth layer was formed, a three-color thermal transfer dye layer of the following composition was coated in such a manner that a thickness thereof after drying became 1 μm, followed by drying, thereby obtaining a thermal transfer dye layer. As described above, thermal transfer sheets of Examples 1 to 11 and Comparative Examples 1 to 9 each having the thermal transfer dye layer on one surface of the base sheet and the heat resistant smooth layer on the other surface were produced. A drying temperature for the formation of the heat resistant smooth layer and the thermal transfer dye layer was 105° C.

<Yellow Color Dye Layer>

Foron yellow (product of Sandoz): 5.0 parts by mass

Polyvinyl butyral resin (product of Sekisui Chemical Co., Ltd., trade name: BX-1): 5.0 parts by mass Methylethylketone: 45.0 parts by mass Toluene: 45.0 parts by mass <Magenta Color Dye Layer>

Foron red: 2.5 parts by mass

Anthraquinone dye (product of Sumitomo Chemical Co., Ltd., trade name: ESC451): 2.5 parts by mass Polyvinyl butyral resin (product of Sekisui Chemical Co., Ltd., trade name: BX-1): 5.0 parts by mass Methylethylketone: 45.0 parts by mass Toluene: 45.0 parts by mass <Cyan Color Dye Layer>

Foron blue (product of Sandoz): 2.5 parts by mass

Indoaniline dye (see the following Structural Formula I): 2.5 parts by mass

Polyvinylal resin (product of Sekisui Chemical Co., Ltd., trade name: BX-1): 5.0 parts by mass Methylethylketone: 45.0 parts by mass Toluene: 45.0 parts by mass

[Chem. 1]

(Structural Formula 1)

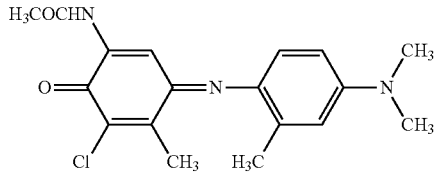

[Evaluation of Thermal Transfer Sheet]

A friction coefficient, running smoothness, sticking, dye storage stability, and thermal head contamination of each of the thermal transfer sheets of Examples 1 to 11 and Comparative Examples 1 to 9 produced as described above were evaluated.

(Evaluation of Friction Coefficient)

Figure 6:
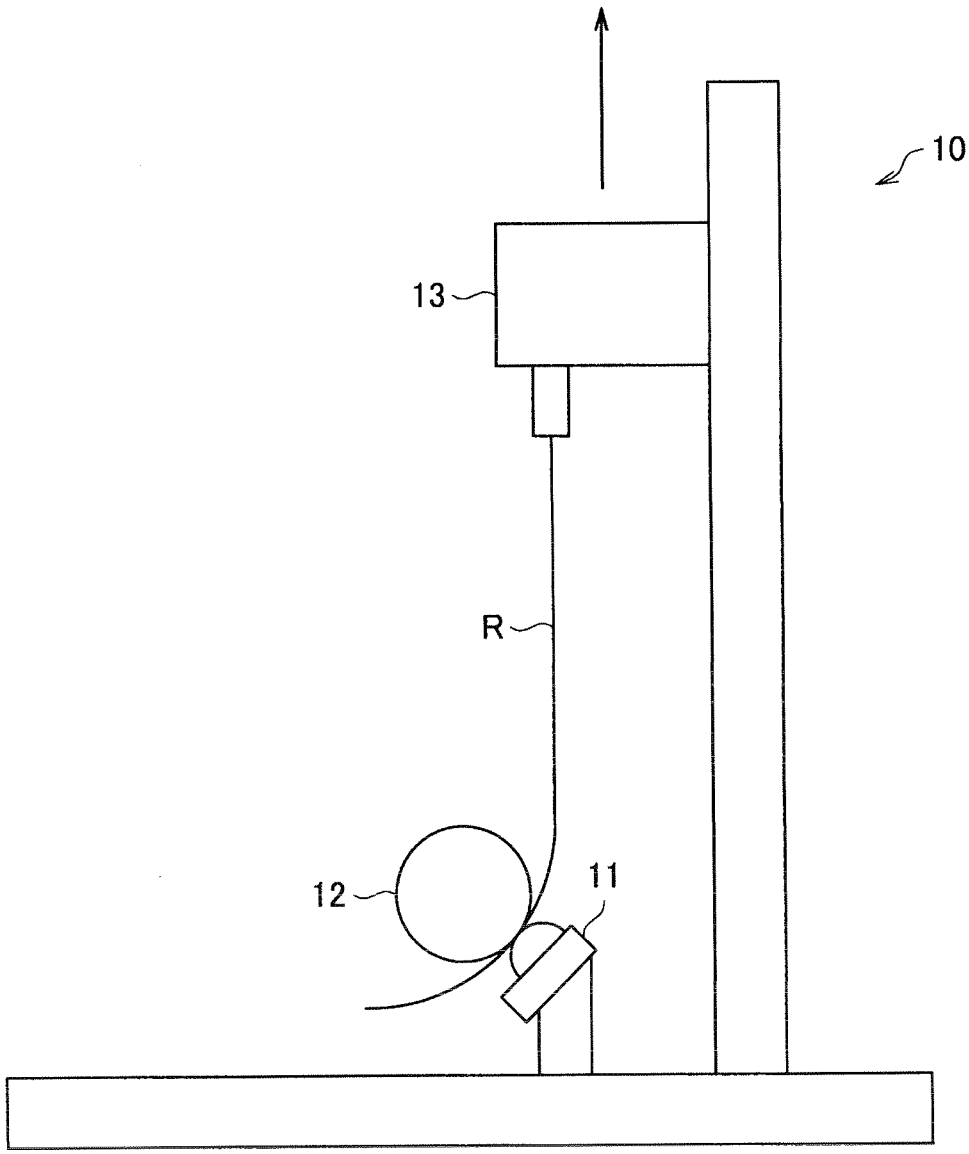
FIG. 6 is an explanatory diagram schematically illustrating a configuration of a friction measurement device used in Examples.

The friction coefficient was measured by using a friction measurement device 10 shown in FIG. 6. The friction measurement device 10 is configured to measure a tension by holding the thermal transfer sheet 100 and a printing paper R between a thermal head 11 and a platen roll 12 and pulling up the thermal transfer sheet 100 and the printing paper with the use of a tension gauge 13. Measurement conditions were as follows.

<Measurement Conditions>

Thermal transfer sheet feeding speed: 450 mm/min

Signal settings

Printing pattern: 2 (Stair Step)

Original document: 3 (48/672 lines, 14 steps)

Strobe division: 1

Strobe pulse width: 20.0 msec

Printing speed: 22.0 msec/line

Clock: 3 (4 MHz)

Head voltage: 18.0 V (Evaluations of Running Smoothness and Thermal Head Contamination)

The running smoothness and thermal head contamination were evaluated by employing the method described below. More specifically, the thermal sheet obtained as described above was mounted on a full-color printer manufactured by Sony Corporation (trade name: UP-DR150), and gradation printing (16 gradations) on a printing paper (product of Sony Corporation, trade name: UPC-R154H) was performed to examine the running smoothness (printing irregularity, crumpling, printing displacement, running noise, and the like) and thermal head contamination.

As to the running smoothness, the thermal transfer sheet which was free from the printing irregularity, crumpling, and the like was evaluated as ○, and the thermal transfer sheet in which the printing irregularity, crumpling, and the like were observed was evaluated as ×.

As to the thermal head contamination, a surface of the thermal head was observed with an optical microscope after repeating the gradation printing for 10000 times, and the thermal transfer sheet with a good result was evaluated as ○, while the thermal transfer sheet by which a deposit was observed and the thermal head was contaminated was evaluated as ×.

(Evaluation of Dye Storage Stability)

As to the dye storage stability, two sheets of each of the above-obtained thermal transfer sheets were used, and the thermal transfer dye layer and the heat resistant smooth layer of the two thermal transfer sheets (20 cm×20 cm) were overlapped with each other. The overlapped thermal transfer sheets were held between two glass plates, and placed in a 50° C. oven for 2 weeks with a weight of 5 kg being applied thereto. Each of the thermal transfer sheets before and after the storage was mounted to a full-color printer manufactured by Sony Corporation (trade name: UP-DR150), and gradation printing (16 gradations) on a printing paper (product of Sony Corporation, trade name: UPC-R154H) was performed to measure color differences among the gradations in terms of chromaticity in a L*a*b* color system by a Macbeth spectral color checker (trade name: SpectroEye). Next, a color phase ΔEab was calculated from the measured chromaticity to evaluate the dye storage stability as the color shift. More specifically, the color shift of ΔEab≦4.5 was evaluated as ○, and the color shift of ΔEab>4.5 was evaluated as ×. Further, a friction coefficient of the heat resistant smooth layer of each of the obtained thermal transfer sheets after being stored at a 50° C. oven for 2 weeks was measured to confirm the friction coefficient after the storage at high temperature.

The results of the above-described evaluations are shown in Table 2 below. As to the friction coefficient in Table 2, a minimum value (min) and a maximum value (max) thereof are shown. Further, "initial friction coefficient" in Table 2 means a friction coefficient which was measured without storing the thermal transfer sheet, and "friction coefficient after storage" means the friction coefficient which was measured after the high temperature storage.

TABLE 2

| | Initial friction coefficient (min) | Initial friction coefficient (max) | Running smoothness | Initial friction coefficient after storage (min) | Initial friction coefficient after storage (max) | Δ Eab | Color shift | Contamination of thermal head |
|---|---|---|---|---|---|---|---|---|
| Example 1 | 0.23 | 0.27 | ○ | 0.25 | 0.28 | 3.4 | ○ | ○ |
| Example 2 | 0.2 | 0.25 | ○ | 0.23 | 0.27 | 3.5 | ○ | ○ |
| Example 3 | 0.16 | 0.24 | ○ | 0.18 | 0.25 | 4 | ○ | ○ |
| Example 4 | 0.19 | 0.23 | ○ | 0.22 | 0.25 | 3.2 | ○ | ○ |
| Example 5 | 0.19 | 0.22 | ○ | 0.22 | 0.25 | 3.2 | ○ | ○ |
| Example 6 | 0.24 | 0.27 | ○ | 0.26 | 0.3 | 3.3 | ○ | ○ |
| Example 7 | 0.22 | 0.26 | ○ | 0.24 | 0.29 | 3.7 | ○ | ○ |
| Example 8 | 0.19 | 0.25 | ○ | 0.24 | 0.28 | 4.2 | ○ | ○ |
| Example 9 | 0.22 | 0.26 | ○ | 0.23 | 0.28 | 3 | ○ | ○ |
| Example 10 | 0.18 | 0.24 | ○ | 0.2 | 0.25 | 3.2 | ○ | ○ |
| Example 11 | 0.16 | 0.24 | ○ | 0.18 | 0.25 | 4.1 | ○ | ○ |
| Comparative Example 1 | 0.17 | 0.24 | ○ | 0.18 | 0.26 | 5.3 | X | ○ |
| Comparative Example 2 | 0.18 | 0.25 | ○ | 0.21 | 0.26 | 4.8 | X | ○ |
| Comparative Example 3 | 0.29 | 0.38 | X | 0.35 | 0.42 | 3.3 | ○ | — |
| Comparative Example 4 | 0.24 | 0.28 | X | 0.27 | 0.33 | 3.5 | ○ | ○ |
| Comparative Example 5 | 0.24 | 0.28 | X | 0.28 | 0.35 | 3.7 | ○ | ○ |
| Comparative Example 6 | 0.19 | 0.25 | ○ | 0.25 | 0.3 | 5.8 | X | ○ |

TABLE 2-continued

| | Initial friction coefficient (min) | Initial friction coefficient (max) | Running smoothness | Initial friction coefficient after storage (min) | Initial friction coefficient after storage (max) | Δ Eab | Color shift | Contamination of thermal head |
|---|---|---|---|---|---|---|---|---|
| Comparative Example 7 | 0.19 | 0.28 | ○ | 0.24 | 0.29 | 8.5 | X | ○ |
| Comparative Example 8 | 0.28 | 0.35 | X | 0.32 | 0.4 | 3.1 | ○ | ○ |
| Comparative Example 9 | 0.18 | 0.23 | ○ | 0.2 | 0.25 | 5.3 | X | ○ |

As is understood from the results shown in Table 2, good running smoothness, low friction, and clear image were obtained in each of the Example 1 to Example 11. Further, since the friction coefficient after storage was not changed so much from the friction coefficient before storage, it was confirmed that the running smoothness after the storage at 50° C. for 2 weeks was satisfactory. Further, since the color shift was very small in Example 1 to Example 11, it was confirmed that good results were attained as to the dye storage stability. As to the thermal head contamination, by the observation of the thermal head in each of Example 1 to Example 11, it was confirmed that contamination did not occur on the surface of thermal head and that the surface of the thermal head was not scraped. Therefore, it was confirmed that the thermal transfer sheet did not exert any adverse influence on the repeated printing and enabled to obtain a good image.

In contrast, in Comparative Examples 1 and 2, though the good results were attained as to the friction coefficient and the thermal head contamination, the change in color phase was large, and the color shift occurred. Transfer of the dye onto the heat resistant smooth layer was found by visual observation, and it was confirmed that the transfer of dye was the cause of the color shift.

In Comparative Example 3, since the phosphoric acid ester was not dissolved into the organic solvent, the evaluation was conducted with the amount of the phosphoric acid ester being adjusted to a soluble amount. As a result, the friction coefficient was increased, and abnormal noise during running was confirmed. Further, since a ribbon was frequently cut during running, continuous running was interrupted. Therefore, the evaluation of thermal head contamination was not conducted.

In Comparative Examples 4 and 5, though the initial friction coefficient and running smoothness were satisfactory, the friction coefficient was increased after the storage at 50° C. for 2 weeks despite the capability of running of the thermal transfer sheet, resulting in the inferior running smoothness.

In Comparative Example 6, the low friction coefficient was attained, and the thermal head contamination was good. However, it was confirmed that the friction coefficient in running smoothness increased after the high temperature storage which was conducted for evaluating the dye storage stability. The running smoothness per se of the thermal transfer sheet after the high temperature storage was satisfactory. Further, in Comparative Example 6, the change in color phase was large, and the color shift occurred:

In Comparative Example 7, the evaluation results of friction coefficient and running smoothness are satisfactory, the change in color phase was large, and the color shift occurred.

In Comparative Example 8, the friction coefficient was high, and, further, the printing was interrupted since a ribbon of the transfer sheet was cut during the evaluation of running smoothness after the high temperature storage which was conducted for evaluating the dye storage stability.

In Comparative Example 9, the evaluation results of friction coefficient, running smoothness, and thermal head contamination were satisfactory. However, since the change in color phase was large, and since the occurrence of color shift was confirmed, the dye storage stability of the thermal transfer sheet was unsatisfactory.

In view of the above, it is confirmed that it is possible to diminish the friction coefficient with the thermal head and to attain the good running smoothness due to the less influence by the storage environment on the friction when the heat resistant smooth layer of the thermal transfer sheet has the following configurations (A) and (B). Furthermore, it is confirmed that it is possible to prevent thermal head contamination, and particularly to improve the dye storage stability, thereby obtaining the good image when the heat resistant smooth layer has the following configurations (A) and (B):

(A) containing as a lubricant phosphoric acid ester having a melting point of 50° C. or more at a ratio of 5 mass % or more and 25 mass % or less; and (B) containing a straight chain phosphoric acid monoalkyl ester at a ratio of 15 to 75 wt % of a total amount of the phosphoric acid ester.

It should be understood by those skilled in the art that various modifications, combinations, sub-combinations and alterations may occur depending on design requirements and other factors insofar as they are within the scope of the appended claims or the equivalents thereof.

The present disclosure contains subject matter related to that disclosed in Japanese Priority Patent Application JP 2011-014308 filed in the Japan Patent Office on Jan. 26, 2011, the entire content of which is hereby incorporated by reference.

What is claimed is:

1. A thermal transfer sheet comprising:

a thermal transfer dye layer formed on one surface of a base sheet and containing a dye and a heat resistant smooth layer formed on the other surface of the base sheet and containing a binder, a lubricant containing phosphoric acid ester having a melting point of 50° C. or more, and a filler, wherein the phosphoric acid ester is contained in the heat resistant smooth layer at a ratio of 5 mass % or more and 25 mass % or less and contains straight chain phosphoric acid monoalkyl ester at a ratio of 16 mass % or more and 75 mass % or less of a total amount of phosphoric acid ester.

2. The thermal transfer sheet according to claim 1, wherein the phosphoric acid monoalkyl ester is monooctadecyl phosphate.

3. The thermal transfer sheet according to claim 1, wherein the binder of the heat resistant smooth layer is crosslinked by a polyisocyanate compound.

4. The thermal transfer sheet according to claim 1, wherein the filler of the heat resistant smooth layer contains spherical particles containing polymethyl silsesquioxane or a mixture of the spherical particles containing polymethyl silsesquioxane and talc which is tabular particles.

* * * * *